US007225961B1

(12) United States Patent
Lee

(10) Patent No.: US 7,225,961 B1
(45) Date of Patent: Jun. 5, 2007

(54) AIR PATH ARRANGEMENT FOR PNEUMATIC NAIL GUN

(75) Inventor: Yi Kuan Lee, Ta-Li (TW)

(73) Assignee: Samson Power Tool Co., Ltd., Da-Li, Taichung County (TW)

( * ) Notice: Subject to any disclaimer, the term of this patent is extended or adjusted under 35 U.S.C. 154(b) by 0 days.

(21) Appl. No.: 11/432,180

(22) Filed: May 11, 2006

(51) Int. Cl.
*B25C 5/06* (2006.01)

(52) U.S. Cl. ..... 227/130; 227/8

(58) Field of Classification Search ..... 227/130, 227/8, 136, 9; 123/46 SC
See application file for complete search history.

(56) References Cited

U.S. PATENT DOCUMENTS 3,808,620 A * 5/1974 Rothfuss et al. ..... 91/308
3,964,659 A * 6/1976 Eiben et al. ..... 227/8
5,687,897 A * 11/1997 Fa et al. ..... 227/8
5,829,660 A * 11/1998 White ..... 227/8
5,924,621 A * 7/1999 Hung ..... 227/130
6,205,894 B1 * 3/2001 Tanaka ..... 81/470
6,431,429 B1 * 8/2002 Canlas et al. ..... 227/130
6,691,907 B1 * 2/2004 Chang ..... 227/8
6,745,928 B2 * 6/2004 Ishizawa et al. ..... 227/130
6,843,400 B1 * 1/2005 Lee ..... 227/8
6,953,137 B2 * 10/2005 Nakano et al. ..... 227/8
7,014,089 B2 * 3/2006 Ishizawa et al. ..... 227/130

* cited by examiner

*Primary Examiner*—Scott A. Smith
(74) *Attorney, Agent, or Firm*—Charles E. Baxley

(57) ABSTRACT

An air path arrangement for a pneumatic nail gun includes cylinder received in a barrel and a handle is connected to the barrel. A space is defined between the cylinder and an inner periphery of the barrel. A connection path communicates between the interior and a first partition of the chamber. A side path communicates between a space between the cylinder and an inner periphery of the barrel, and a second partition of the chamber. The first partition communicates with an inlet and an outlet in the handle. A movable member, a guide member, a valve, an axle and a base are received in the chamber. The guide member is located between the first and second partitions. The guide member has apertures which communicates with the first and second partitions so that the movable member and the valve are movably received in the first partition and the second partition.

10 Claims, 4 Drawing Sheets

AIR PATH ARRANGEMENT FOR PNEUMATIC NAIL GUN

FIELD OF THE INVENTION

The present invention relates to an air path arrangement for pneumatic nail gun and includes less number of parts.

BACKGROUND OF THE INVENTION

A conventional pneumatic nail gun is able to continuous shoot with one pull of the trigger. However, the function requires a special path arrangement in the nail gun and a large number of parts are involved to achieve the purpose. The parts are installed in the limited space in the nail gun and require high standard of precision of machining so that the manufacturing cost is so high that the nail gun do not have better competitive price in the market. Besides, to assemble the large number of parts is a time-consuming task which includes the labor cost.

The present invention intends to provide an air path arrangement for a pneumatic nail gun and the arrangement does not need a large number of parts and the parts are easily to be assembled.

SUMMARY OF THE INVENTION

The present invention relates to an air path arrangement for a pneumatic nail gun which comprises a body having an interior defined in a barrel of the body so as to receive a cylinder therein, and a chamber is defined in a handle connected to the barrel. A piston unit is received in the cylinder and a space is defined between the cylinder and an inner periphery of the barrel of the body. A connection path communicates between the interior and a first partition of the chamber, and a side path communicates between the space and a second partition of the chamber. The first partition communicates with an inlet and an outlet in the handle. A movable member, a guide member, a valve, an axle and a base are received in the chamber. The guide member is located between the first and second partitions. The guide member has apertures which communicate with the first and second partitions so that the movable member and the valve are movably received in the first partition and the second partition.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
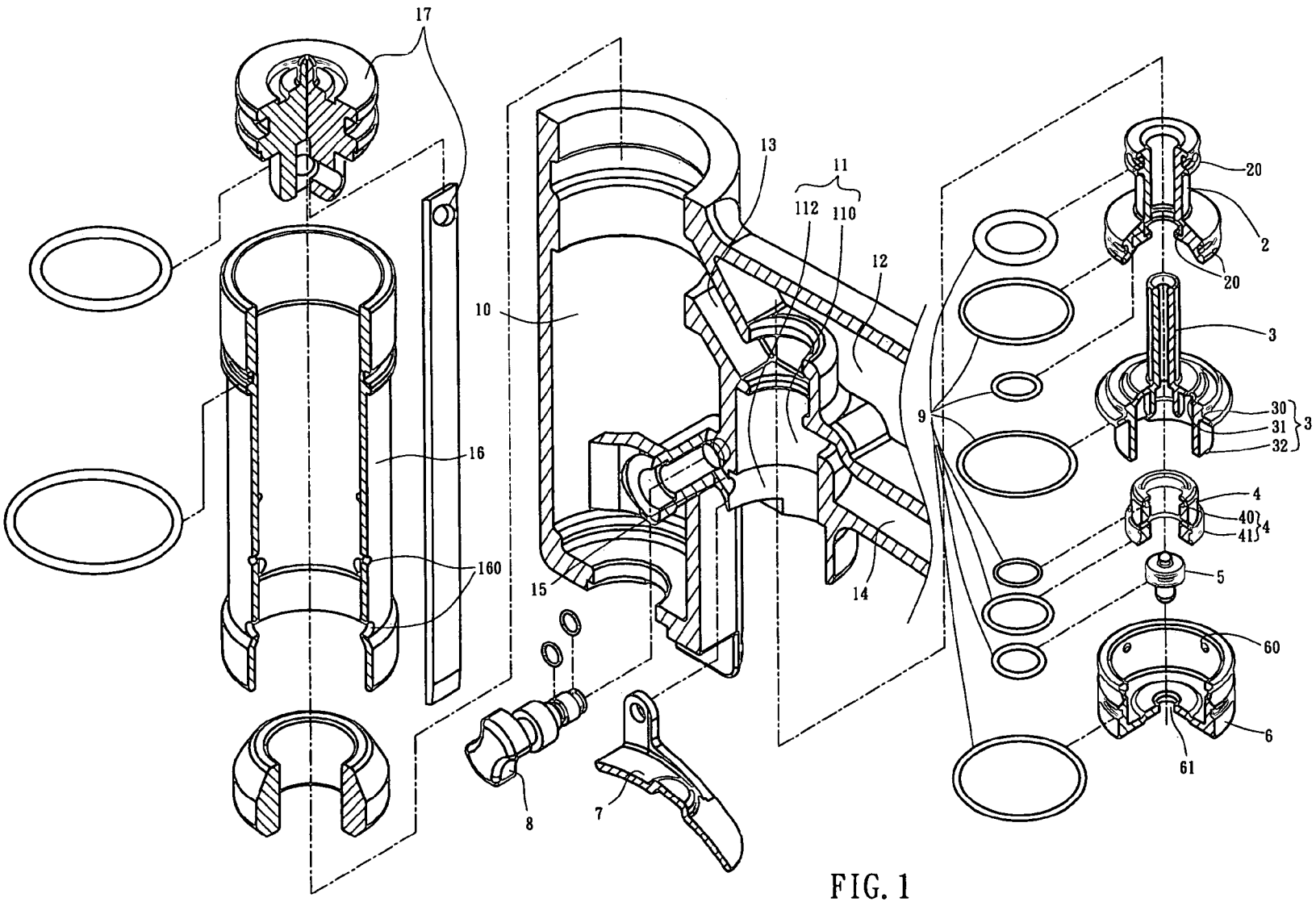
FIG. 1 is an exploded view to show the parts of the air path arrangement for a pneumatic gun of the present invention.

Referring to FIGS. 1 to 6, the air path arrangement for a pneumatic nail gun of the present invention comprises a body 1 which includes a barrel and a handle which is connected to the barrel. The barrel has an interior 10 defined therein and a cylinder 16 is received in the interior 10. A piston unit 17 is received in the cylinder 16, and a space 18 is defined between the cylinder 16 and an inner periphery of the barrel of the body 1. A chamber 11 is defined in the handle connected to the barrel and includes a first partition 110 and a second partition 112. A connection path 13 communicates between the interior 10 and the first partition 110 of the chamber 11. A side path 15 communicates between the space 18 and the second partition 112 of the chamber 11. The first partition 110 communicates with an inlet 12 and an outlet 14 in the handle.

A movable member 2, a guide member 3, a valve 4, an axle 5 and a base 6 are received in the chamber 11. The movable member 2 is a hollow member and has a seal 9 engaged with a groove 20 in the movable member 2, the seal 9 is in contact with an inner periphery of the chamber 11 and the guide member 3. The movable member 2 is movable relative to the guide member 3, such that the movable member 2 is movable within the first partition 110. The movement of the seal 9 on the movable member 2 controls whether the air in the inlet 12 enters the interior 10 via the connection path 13, or the air in the interior 10 enters the outlet 14 via the connection path 13.

The guide member 3 is a hollow member and includes a central passage, the guide member 3 is located between the first and second partitions 110, 112. The first partition 110 is defined between an inner periphery of the chamber 11 and an outer periphery of the guide member 3. The second partition 112 is defined between an inner periphery of the chamber 11 and an inner periphery of the base 6. A seal 9 is engaged with a groove 30 and clamped between the guide member 3 and the chamber 11. The guide member 3 has apertures 31 which communicate with the first and second partitions 110, 112 so that the movable member 2 and the valve 4 are movably received in the first partition 110 and the second partition 112. The guide member 3 has a gap 32 formed at an end thereof and the gap 32 communicates with the side path 15. The gap 32 can be any known form such as a slot, a notch, or a slit. The gap 32 is located between the guide member 3 and an inner periphery of the base 6. The side path 15 and the gap 32 can be in communication with each other directly or indirectly via orifices 60 defined through the base 6.

Figure 3:
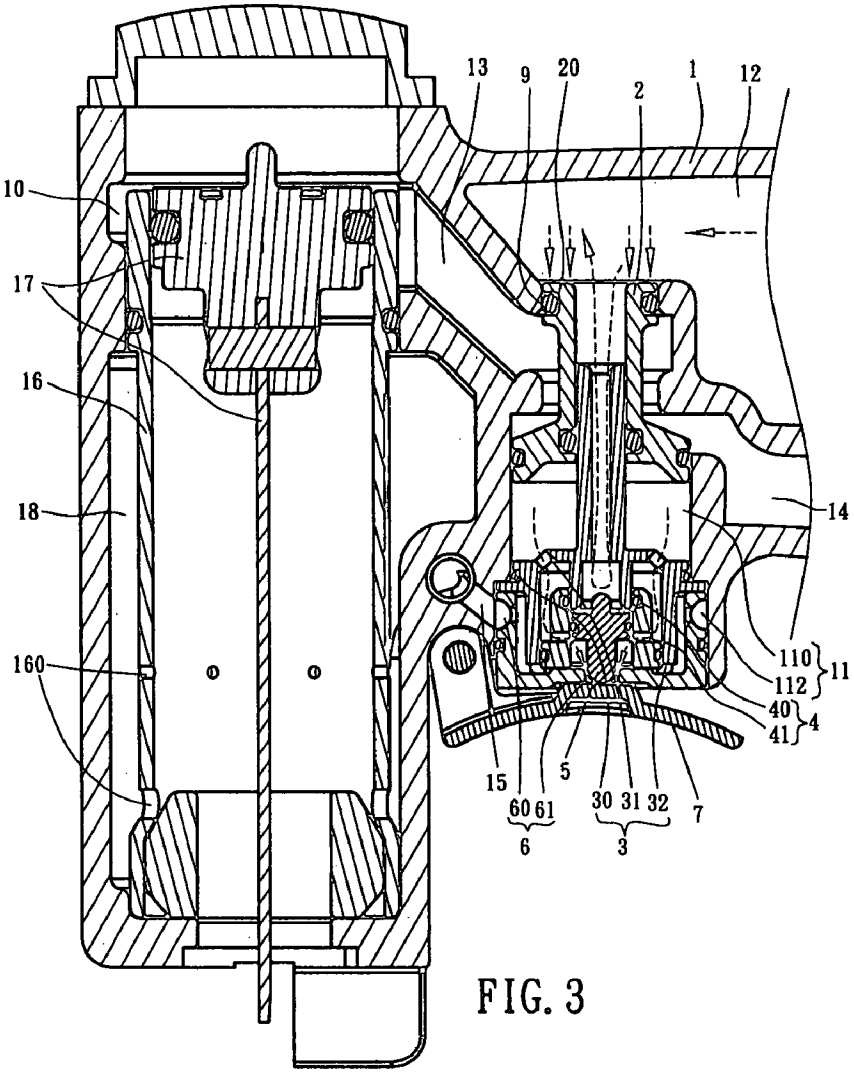
FIG. 3 is a cross sectional view to show the air path arrangement of the present invention, wherein the trigger is pulled.
Figure 2:
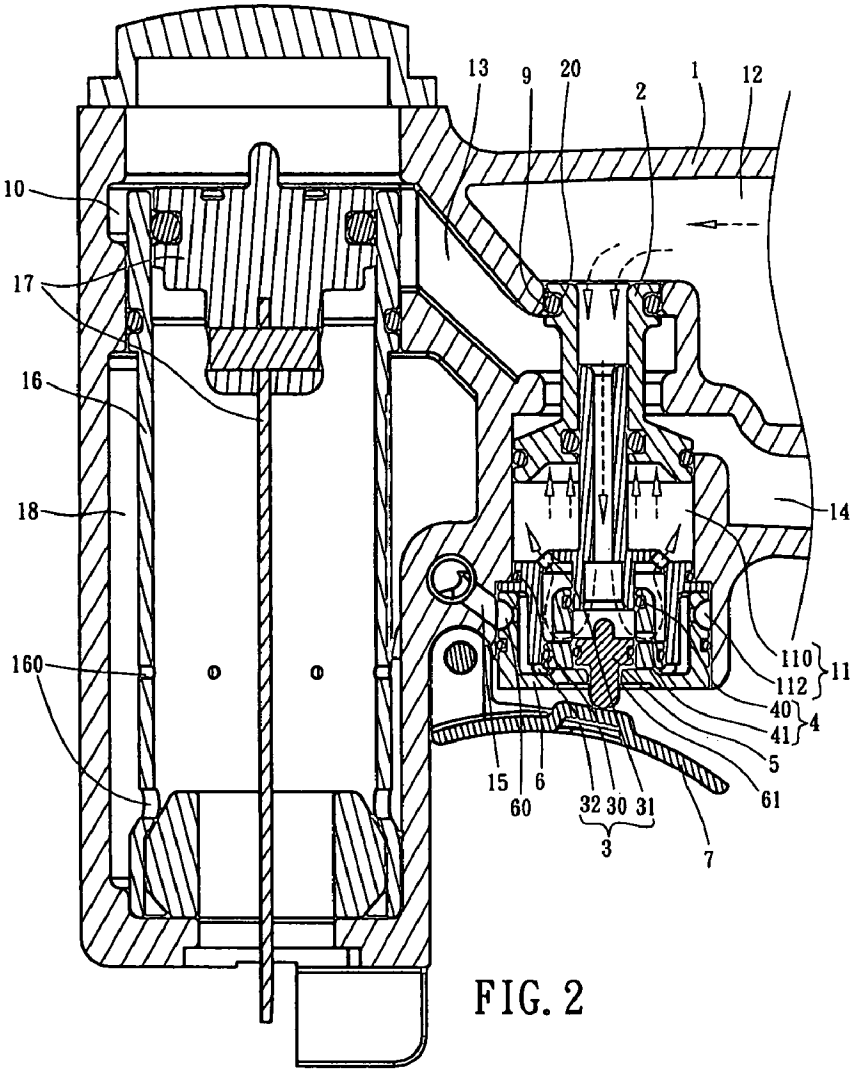
FIG. 2 is a cross sectional view to show the air path arrangement of the present invention.
Figure 6:
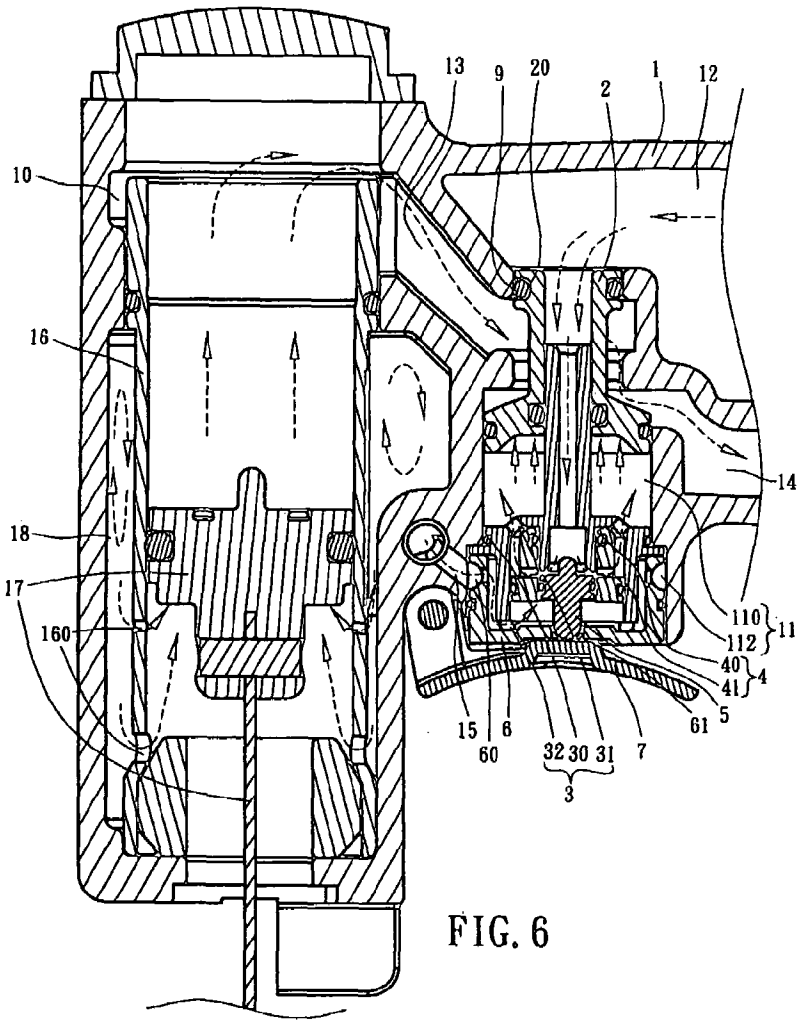
FIG. 6 shows that the movable member is moved back to its original position.

The valve 4 is a hollow member and has a groove 40 and radial holes 41. A seal 9 is engaged with the groove 40 and located between the valve 4 and the guide member 3. The seal 9 is in contact with the guide member 3. The axle 5 is movably extends through the valve 4 so as to control the communication of the radial holes 41 with outside of the valve 4. The area of one end of the movable member 2 is larger than the other end so that the movable member 2 is moved toward the smaller end until the seal 9 on the movable member 2 is located at a position where the air in the inlet 12 cannot enter into the chamber 11. The connection path 13 is no in communication with the outlet 14 as shown in FIG. 6 and the air above the piston unit 17 as shown in FIG. 6 escapes from the outlet 14 via the connection path 13. Therefore, the piston unit 17 is moved back to its original position. The valve 4 is then moved and the radial holes 41 are moved to the position where the seal 9 on the axle 5 is located above the radial holes 41 as shown in FIG. 3.

An adjustment member 8 can be installed in the side path 15 and the gap between the adjustment member 8 and the inner periphery of the side path 15 decides the speed that the air in the space 18 escapes to the gap 32 so as to control the speed of the continuous shooting.

Figure 7:
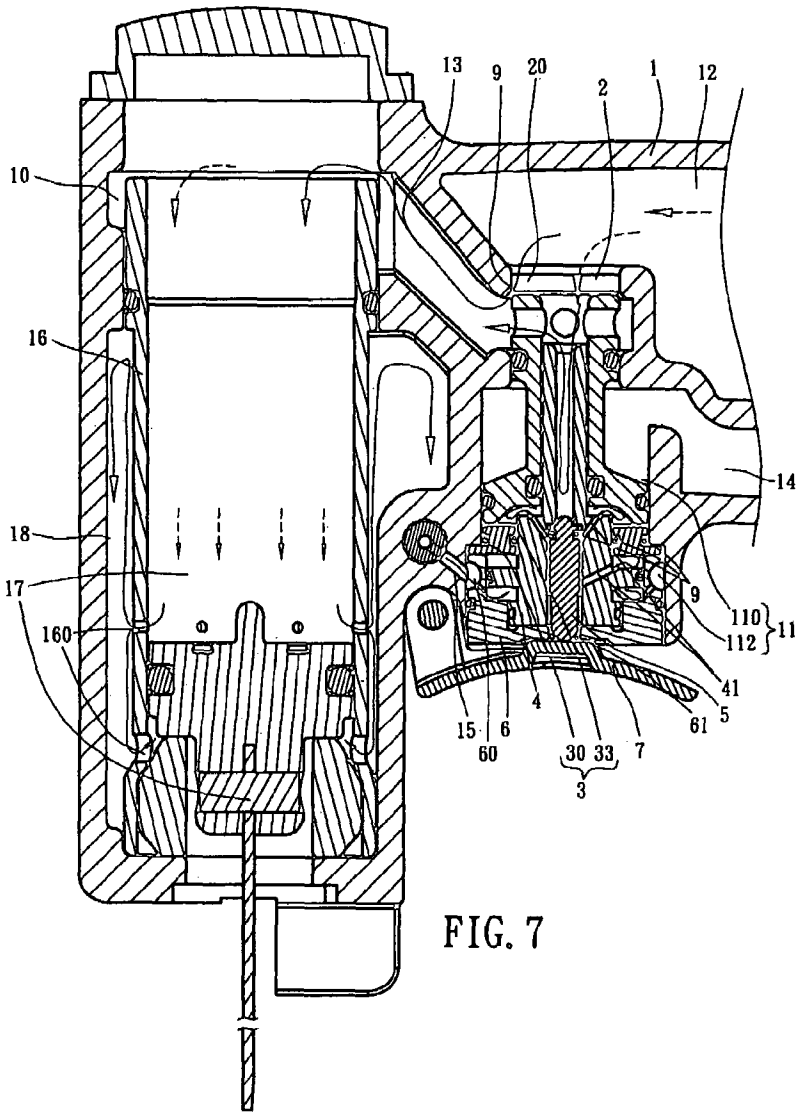
FIG. 7 shows another embodiment of the present invention.

As shown in FIG. 7, which shows another embodiment of the present invention, wherein the guide member 3 has an axial passage 33, two seals 9 are respectively engaged with the groove 30 and the axial passage 33. The valve 4 extends through the axial passage 33 and is received in the movable member 2 so that the seals 9 on the guide member 3 are located between the guide member 3 and the chamber 11, and between the guide member 3 and the valve 4. The guide member 3 separates the first and second partitions 110, 112, and the holes 42 in the valve 4 are in communication between the first and second partitions 110, 112. The seal 9 on the axle 5 is located in the valve 4 and controls the entrance of the air from the valve 4 to the first partition 110 via the holes 42.

Figure 4:
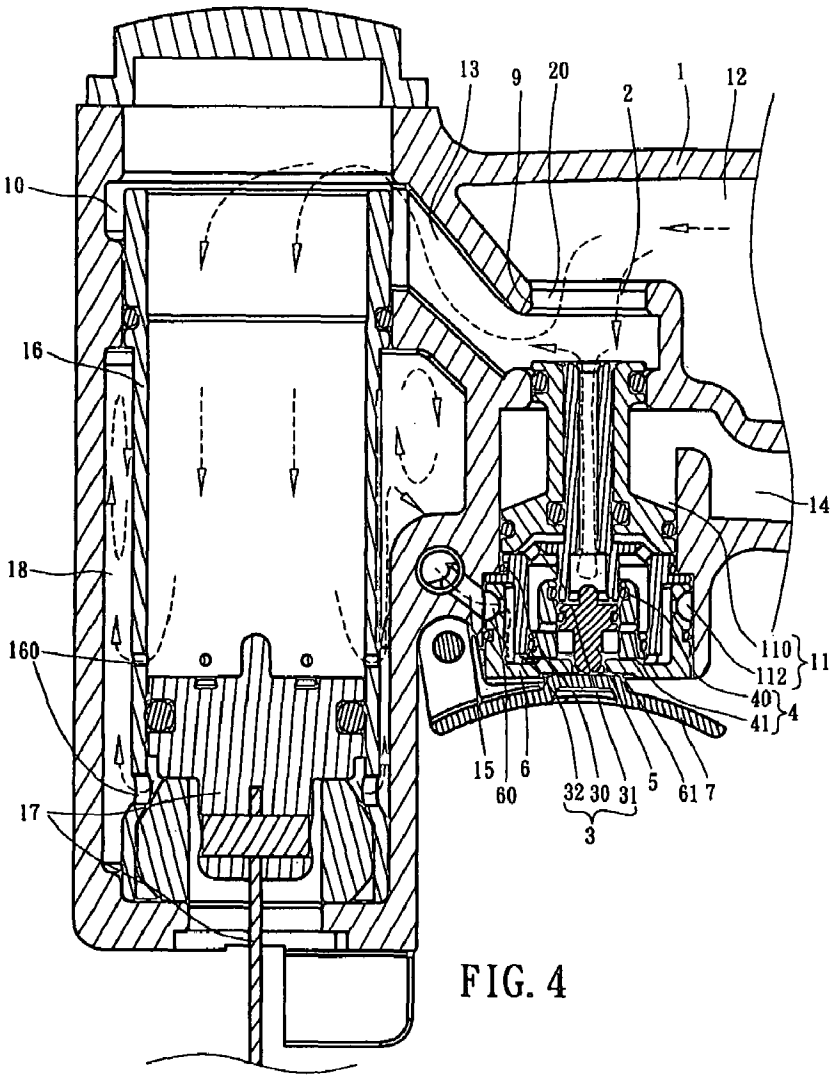
FIG. 4 shows that the piston unit in the cylinder is pushed to eject a nail and the movable member is moved.

When shooting, the user pulls the trigger 7 to push the axle 5 until a seal 9 on the axle 5 is moved to the radial holes 41. The movement of the axle 5 allows the first partition 110, the apertures 31, the second partition 112, the radial holes 41 and the central hole 61 in the base 6 to be in communication with each other as shown in FIG. 3. The pressure in the inlet 12 is larger than the pressure in the first partition 110 such that the movable member 2 is pushed until the seal 9 on the movable member 2 seals the neck portion of the chamber 10. This makes the inlet 12 communicate with the connection path 13, and the connection path 13 is not in communication with the outlet 14. Therefore, the air enters into the cylinder 16 and pushes the piston unit 17 to eject a nail (not shown). The air in the cylinder 16 is then pushed out and enters into the space 18 via the through holes 160 defined through a wall of the cylinder 16. The air then enters the second partition 112 and the gap 32 via the side path 15 and the orifices 60 in the base 6 as shown in FIG. 4.

Figure 5:
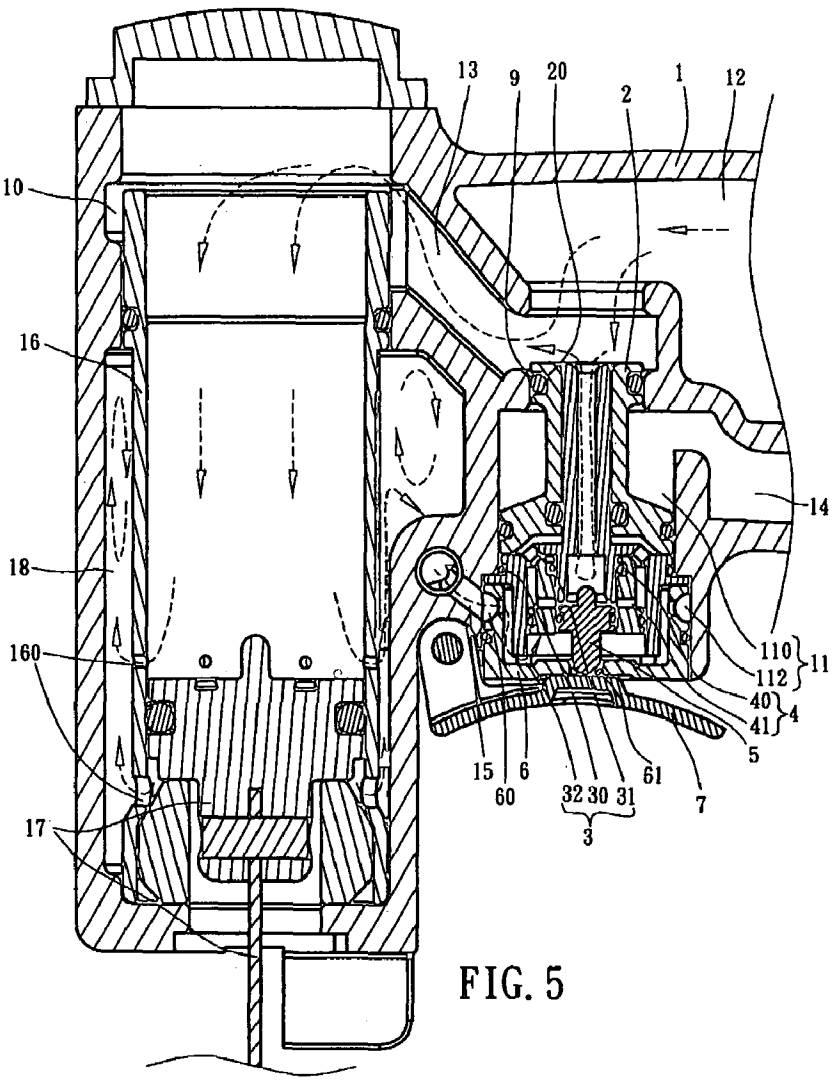
FIG. 5 shows that the valve is pushed and toward the movable member.

In the meanwhile, the pressure between the inner periphery of the valve 4 and the inner periphery of the guide member 3 is smaller than the pressure between the outer periphery of the valve 4 and the inner periphery of the base 6, so that the air that is provided from the space 18 and in the gap 32 pushes the valve 4 until the radial holes 41 are moved to the position as shown in FIG. 5. The air in the inlet 12 enters into the first partition 110 via the gap between the guide member 3 and the axle 5, and via the radial holes 41 and the apertures 31.

While we have shown and described the embodiment in accordance with the present invention, it should be clear to those skilled in the art that further embodiments may be made without departing from the scope of the present invention.

What is claimed is:

1. An air path arrangement for a pneumatic nail gun, comprising:

a body (1) having an interior (10) defined in a barrel of the body (1) and a chamber (11) defined in a handle connected to the barrel, a cylinder (16) received in the interior (10) and a piston unit (17) received in the cylinder (16), a space (18) defined between the cylinder (16) and an inner periphery of the barrel of the body (1), a connection path (13) communicating between the interior (10) and a first partition (110) of the chamber (11), a side path (15) communicating between the space (18) and a second partition (112) of the chamber (11), the first partition (110) communicating with an inlet (12) and an outlet (14) in the handle, and a movable member (2), a guide member (3), a valve (4), an axle (5) and a base (6) received in the chamber (11), the guide member (3) located between the first and second partitions (110, 112), the guide member (3) having apertures (31) which communicate with the first and second partitions (110, 112) so that the movable member (2) and the valve (4) are movably received in the first partition (110) and the second partition (112).

2. The arrangement as claimed in claim 1, wherein the guide member (3) has a gap (32) formed at an end thereof and the gap (32) communicates with the side path (15).

3. The arrangement as claimed in claim 2, wherein the side path (15) and the gap (32) are in communication with each other indirectly via orifices (60) defined through the base (6).

4. The arrangement as claimed in claim 2, wherein the gap (32) is located between the guide member (3) and an inner periphery of the base (6).

5. The arrangement as claimed in claim 1, wherein the base (6) has orifices (60) defined therethrough.

6. The arrangement as claimed in claim 1, wherein the movable member (2) has a seal (9) mounted thereto which is in contact with an inner periphery of the chamber (11) and the guide member (3), the movable member (2) is movable relative to the guide member (3), such that the movable member (2) is movable within the first partition (110).

7. The arrangement as claimed in claim 1, wherein the movable member (2) has a seal (9) mounted thereto which is clamped between an inner periphery of the chamber (11) and the guide member (3) so as to separate the first and second partitions (110, 112), the guide member (3) has the apertures (31) defined therethrough which communicates with the first and second partitions (110, 112).

8. The arrangement as claimed in claim 1, wherein the valve (4) has a groove (40) and radial holes (41), a seal (9) is engaged with the groove (40) and located between the valve (4) and the guide member (3), the seal (9) is in contact with the guide member (3), the axle (5) is movably extends through the valve (4) so as to control the communication of the radial holes (41) with outside of the valve (4).

9. The arrangement as claimed in claim 1, wherein the first partition (110) is defined between an inner periphery of the chamber (11) and an outer periphery of the guide member (3).

10. The arrangement as claimed in claim 1, wherein the second partition (112) is defined between an inner periphery of the chamber (11) and an inner periphery of the base (6).

* * * * *